United States Patent [19]

Frederiksen

[11] 4,114,362

[45] Sep. 19, 1978

[54] ELECTRONIC TIMEPIECE

[75] Inventor: John E. Frederiksen, Garland, Tex.

[73] Assignee: Texas Instruments Incorporated, Dallas, Tex.

[21] Appl. No.: 777,382

[22] Filed: Mar. 14, 1977

[51] Int. Cl.[2] ..... G04B 19/24; G04C 3/00

[52] U.S. Cl. ..... 58/4 A; 58/23 R; 58/50 R; 58/58; 58/85.5

[58] Field of Search ..... 58/4 A, 23 R, 50 R, 58/58, 85.5

[56] References Cited

U.S. PATENT DOCUMENTS

| | | | |
|---|---|---|---|
| 3,834,151 | 9/1974 | Bodet | 58/4 A |
| 3,961,472 | 6/1976 | Riehl | 58/4 A |
| 3,962,858 | 6/1976 | Levine et al. | 58/4 A |

*Primary Examiner*—Stanley J. Witkowski

*Attorney, Agent, or Firm*—Rene' E. Grossman; Stephen S. Sadacca

[57] ABSTRACT

An electronic timepiece includes circuit means by which the date counter thereof is automatically set to 28 days for February, and alternately, simply settable to 29 days for February occurring during a leap year.

10 Claims, 4 Drawing Figures

Fig. 1
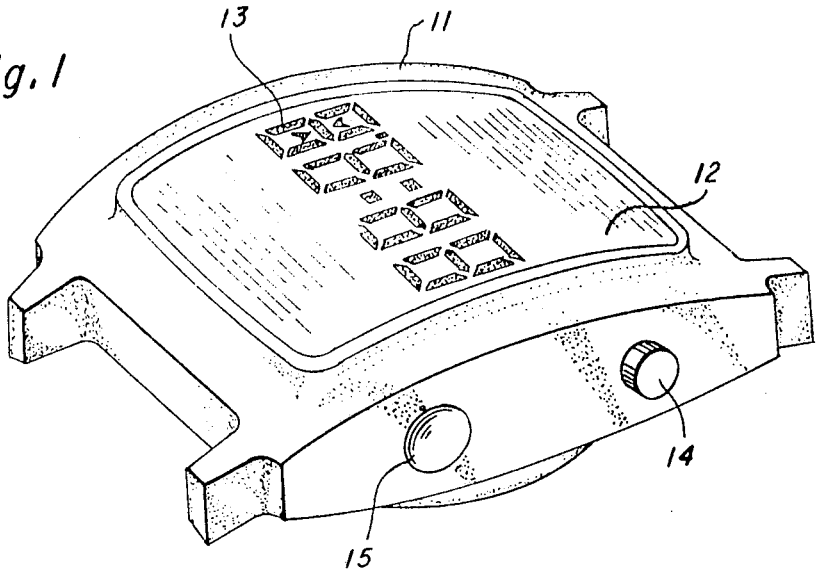
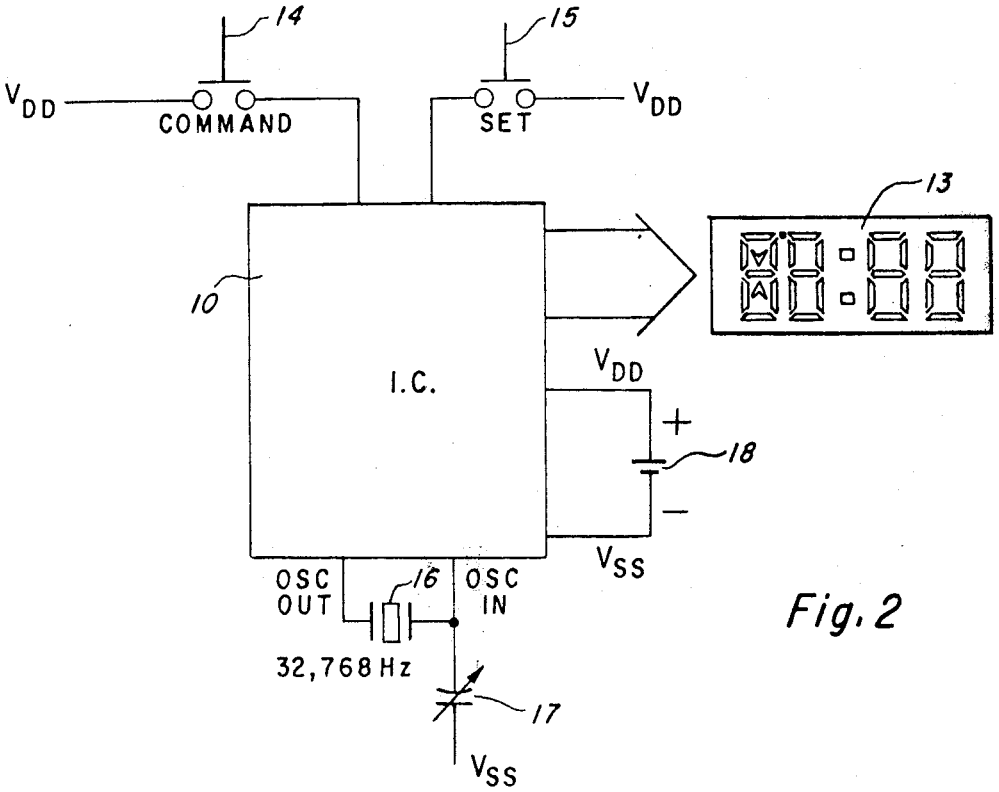
Fig. 2

ELECTRONIC TIMEPIECE

BACKGROUND OF THE INVENTION

This invention relates to electronic timepieces and more particularly to an electronic timepiece having a circuit for setting a date counter thereof to the appropriate number of days in February during normal and leap years.

Electronic timepieces presently on the market have utilized various schemes for advancing and setting in date counter. Some timepieces advance to 31 for each month and must be manually set for months which have less than 31 days. Watches which select the number of days associated with each month always count to 29 during February and must be manually set for Februaries which have 28 days. Other watches always change from February 28 to March 1, an indication of February 29 being non-existent; the watch will indicate March 1 on February 29 and then be reset to March 1 on March 1. Still another prior art scheme utilized allows for the manual setting of the watch to February 29 by first setting the watch to March 29 and then resetting the month to February.

It is therefore an object of the present invention to provide an improved electronic timepiece.

It is another object of the invention to provide an electronic timepiece which provides simple means for setting the date counter thereof to the appropriate number of days for February during normal and leap years.

It is a further object of the invention to provide an electronic timepiece which automatically advances to February 28 and which is simply manually set to February 29 during leap years.

BRIEF DESCRIPTION OF THE INVENTION

These and other objects are accomplished in accordance with the present invention in which an electronic timepiece is provided with a selection circuit coupled to the date counter. The selection circuit thereof allows the date counter to advance from February 28 to March 1 during the normal timekeeping mode. During leap year, the selection circuit allows the date counter to be manually set to February 29. The selection circuit senses whether the watch is in the normal timekeeping mode and, if so, provides an indication to a date decoder circuit which causes the month/date counters to be reset to March 1 upon the present month/date being February 28, and a carry pulse being received from the hours counter. If the selection circuit senses that the watch is in the set mode, the date counter will be settable to 29 with the month counter remaining at February. Returning to the timekeeping mode, the watch will not change to March 1 until the next carry pulse from the hours counter.

BRIEF DESCRIPTION OF THE DRAWINGS

Still further objects and advantages will become apparent from the detailed description and claims when read in conjunction with the accompanying drawings wherein:

FIG. 1 is a perspective view of an electronic timepiece incorporating the present invention;

FIG. 2 is a schematic diagram of the electronic watch of FIG. 1;

DETAILED DESCRIPTION OF THE PREFERRED EMBODIMENTS

Figure 3:
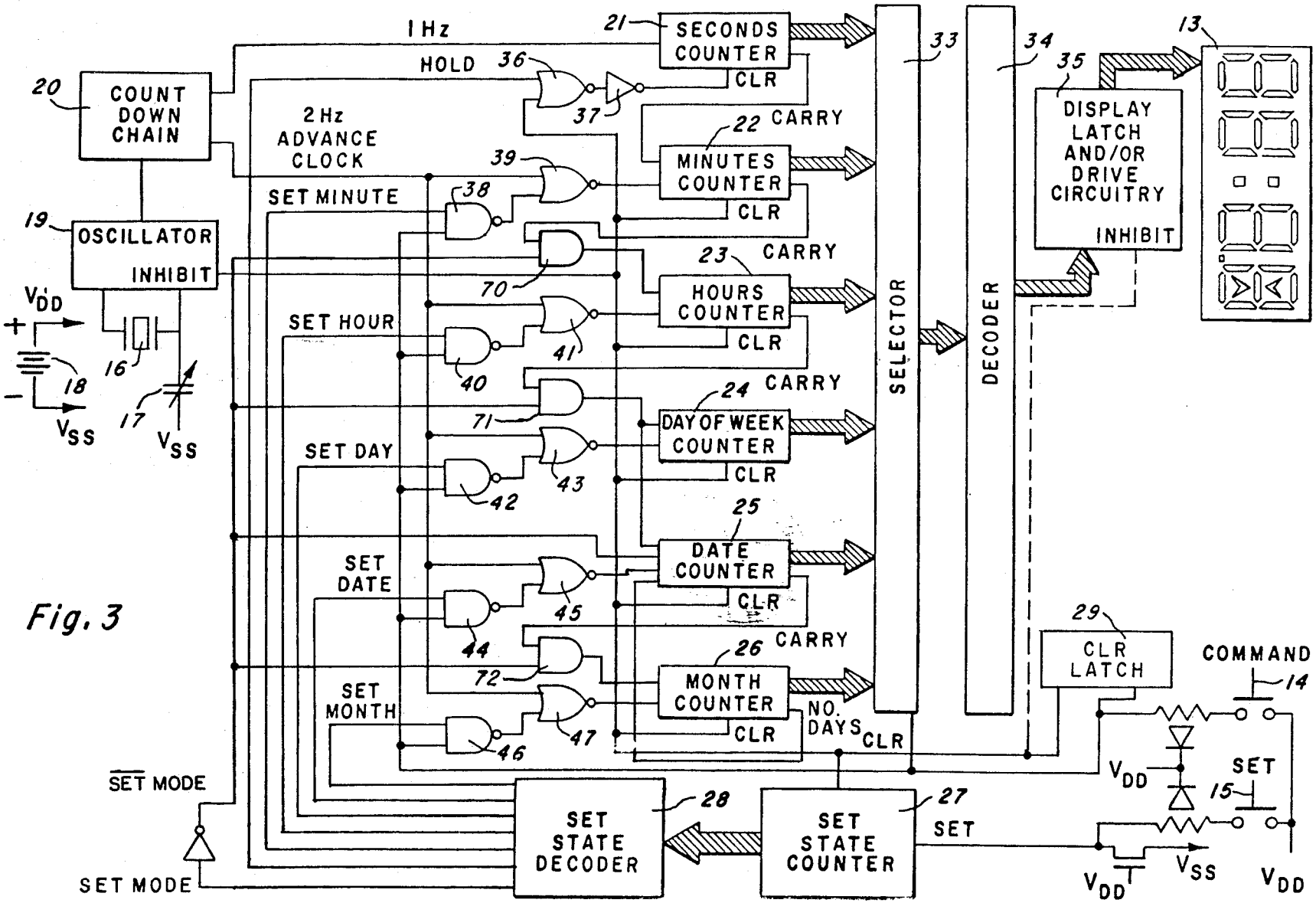
FIG. 3 is a more detailed circuit-logic diagram of the electronic watch of FIG. 1.

Referring then to the drawings, and particularly to FIG. 1, an electronic timepiece comprising the present invention is shown. The electronic timepiece includes a housing (i.e., watch case) 11 having a lens member 12 through which a display 13 is visible from without the housing. The electronic timepiece also includes a COMMAND switch 14 and a SET switch 15. Where the display is a passive display, such as a liquid crystal or electrochromic display, time or some other time-related function may be continuously displayed, and COMMAND switch 14 utilized to change the particular time-related information being displayed at any given time. For example, where hours and minutes are displayed continuously, the COMMAND switch 14 may be utilized to change the hours:minutes information being displayed to a display of seconds, day of the week, date and/or month. In an active display timepiece, such as that which employs a light emitting diode display, the display is normally off to conserve battery power; in this instance, the COMMAND switch 14 is utilized not only to select the particular time-related information to be displayed, but also to turn on the display. SET switch 15 is utilized to select the time-related function to be set (i.e., seconds, minutes, hours, day of the week, date, and/or month) and is utilized in conjunction with COMMAND switch 14 which, in conjunction with a clocking signal, skews the function selected by the SET switch 15.

The electronic components contained within the case 11 are illustrated in the schematic diagram of FIG. 2.

Referring then to FIG. 2, a semiconductor integrated circuit chip 10, which is preferably of the CMOS or $I^2L$ type, is shown. Integrated circuit chip 10 includes all of the electronics necessary to provide the desired timekeeping functions, and operates from one or two miniature batteries 18 which, for an electronic wrist watch, are generally pill-type batteries. Integrated circuit chip 10 includes the oscillator circuitry for generating a timing signal; however, a quartz crystal 16, which provids a reference frequency, and a variable capacitor 17, which provides for frequency adjustment, are provided external to the integrated circuit chip and connected to the oscillator circuit. Integrated circuit chip 10 is connected to a display 13 to display one or more time functions simultaneously or in a sequence selected either automatically or in response to activation of COMMAND switch 14.

COMMAND switch 14 and SET switch 15 selectively couple a voltage potential ($V_{DD}$) from battery source 18 to integrated circuit chip 10 to activate the respective function in the electronic circuitry contained in integrated circuit chip 10.

As previously mentioned, integrated circuit chip 10 is referrably CMOS or $I^2L$ (conventional MOS or bipolar circuitry may be utilized in other embodiments, if desired) and the display may be active (i.e., LED) or passive (LCD or electrochromic). For simplicity, a CMOS-LCD embodiment of the electronic timepiece will herein be discussed in detail; however, it should be understood that an electronic timepiece comprising any combination of the above is contemplated by the present invention. Further, although a particular electronic watch circuit is discussed, it is comtemplated that any conventional watch circuitry could be utilized in combination with the disclosed novel selection circuit to provide an electronic timepiece in accordance with the present invention.

Referring then to FIG. 3, a schematic diagram of an electronic timepiece incorporating a novel selection circuit, in accordance with the present invention, is illustrated. A pill-sized battery 18 provides a voltage potential between negative terminal $V_{SS}$ and positive terminal $V_{DD}$. Battery 18 is utilized to provide power to all of the CMOS circuitry; however, only selected connections to the battery relating to the present invention are specifically designated in FIG. 3. Integrated circuit 10 includes oscillator 19 which operates in conjunction with external crystal 16 and variable capacitor 17 as indicated above. The output of the oscillator which, in the present embodiment, is nominally 32,786 Hz, is coupled to a countdown chain 20 of serially-coupled flip-flops which reduce the frequency to a 1-Hz time signal. Countdown chain circuit 20 is also taped at various intermediate points to provide other operating clock signals such as the indicated 2-Hz clock signal for advancing the various minutes, hours, day, date, month, etc, counters during the setting procedure. In normal operation, the 1-Hz signal is applied to seconds counter 21 which counts seconds and provides binary (e.g., binary coded decimal) output signal indicative thereof. As seconds counter 21 advances from 59 to 0 seconds, a signal is generated to minutes counter 22 which advances one count each 60 seconds or minute. Minutes counter 22 generates a coded output signal indicative of the minutes count, and generates a signal to hours counter 23 once each 60 minutes. Hours counter 23 advances one count each 60 minutes or hour in sets of 12 and/or 24 hours, and provides a coded output signal indicative of the hour count. Counter 23 also generates a signal once each 24 hours to counters 24 and 25 to advance the day of the week an date, respectively. Counter 24 counts seven days of the week and provides a coded signal indicative thereof; counter 25 counts up to 31 days, the particular number of days being dependent upon month (NO. DAYS) signals fed back to counter 25 from month counter 26, and provides a coded output signal indicative thereof. Date counter 25 is, in accordance with the present invention, programmed by means of a selection circuit and decoder to counter subsets of 31 days, such as 28 and/or 29 days for February, and 30 days for April, June, September and November as will later be discussed specifically with respect to FIG. 4. Date counter 25 also generates a signal once each 31 days (or sub-set of 31) to month counter 26. Month counter 26 counts 12 months, and provides a coded output signal indicative thereof. Counter 26 also feeds back a month indication to the date decoder so that the number of days per month is automatically computed as indicated above. The coded output signals generated by each of counters 21–26 are selectively transmitted by means of selector circuit 33 to decoder circuit 34. Selector circuit 33, which is coupled to and controlled by COMMAND switch 14, selects and multiplexes the digits to be displayed. For example, with an LCD continuous readout timepiece, hours and minutes may be continuously displayed on the four digits of display 13 with the coded outputs from hours counter 23 and minutes counter 22 being selected one digit at a time by selector circuit 33, decoded by decoder circuit 34 from the binary (e.g., binary coded decimal) coded format into display coded format which is stored and provided by latch/driver circuitry 35 to display 13. A single press of the button of COMMAND switch 14 may, for example, change selector circuit 33 to a second mode in which the output from seconds counter 21 is transferred to decoder 34, decoded into display format and displayed on two digits of display 13. Similarly, with two presses of the button of COMMAND switch 14, for example, the date and month coded outputs from counters 25 and 26, respectively, are selected by selector 33, decoded into display coded format by decoder 34 and displayed on the four digits of display 13. With three presses of the button of COMMAND switch 14, the day-of-the week coded output signal is selected from counter 24 by selector 33, decoded into display coded formal at decoder 34 and displayed by the special alphanumeric font characters provided as the lefthand digits of display 13. Such alphanumeric characters are the subject of design patent application Ser. No. 667,598, filed on Apr. 16, 1976, by Perry H. Pelley, entitled "FONT OF TEN SEGMENT CHARACTERS," now abandoned and assigned to the assignee of the present invention.

The electronic timepiece illustrated in FIG. 3 includes a latch circuit 29 which is initially set by connection of battery power source 18 in the circuit which supplies voltage levels $V_{DD}$ and $V_{SS}$ to the circuitry of the electronic timepiece at the points indicated. When this occurs, latch 19 is toggled to a set condition which inhibits oscillator 19 by providing a short across the oscillator input thereby preventing dynamic power consumption by the rest of the electronic circuitry. In the SET condition, latch 19 also inhibits display drive circuitry 35 to prevent power consumption by display 13, and generates a CLR signal to clear counters 22–27 (and any other of the circuitry which it is desired to initialize to a predetermined condition). The electronic timepiece remains in this "shutdown" condition during its entire "shelf-life". When the COMMAND switch 14 is next activated (by a consumer, for example), latch circuit 29 is toggled to a RESET condition which uninhibits oscillator circuit 19 and display drive circuitry 35 to power up the electronic circuitry and display 13 and the timekeeping (or set) function commences from the predetermined initialized condition. Latch circuit 29 is the subject matter of copending U.S. patent application Ser. No. 759,696, filed Jan. 17, 1977, now U.S. Pat. No. 4,065,916 and assigned to the assignee of the present invention.

The setting of the electronic timepiece has been briefly described with respect to FIG. 1. The means by which the setting is accomplished is now discussed in detail with reference to FIG. 3 and the particular feature embodied in the present invention with respect to FIG. 4. Set state counter 27, coupled to SET switch 15, advances one state each time SET switch 15 is activated, and generates a binary (or other) coded signal indicative of the contemporary count. In general, one count is provided for the setting of each function counter 22–26 (seconds counter 21 is cleared to an initial zero-count state during the SET MINUTE mode, but is not otherwise set) in addition to a neutral or off state in which the electronic timepiece runs in the normal timekeeping mode; hence, for the illustrated embodiment, counter 27 is a six-state counter. Set state decoder 28, coupled to counter 27, generates, one at a time in sequency, set signals: SET MONTH, SET DATE, SET DAY, SET HOUR and SET MINUTE. A SET MODE signal is generated while the set state counter 27 is in any one of the set modes (that is, so long as it is not in the neutral timekeeping state); the SET MODE signal is utilized to disable the carries from counter to counter by means of AND gates 70–72 so that each of counters 22–26 may be independently set. Set state decoder 28 also generates a HOLD signal during the SET MINUTE mode; the HOLD SIGNAL is applied via NOR gate 36 and NOT gate 37 to the CLR input of seconds counter 21 to retain seconds counter 21 in the initial zero-count state during the SET MINUTE mode as mentioned above. Since, the present embodiment, the SET MINUTE mode is the last in the set state counter sequence, seconds counter 21 is restarted at the zero-count state at the instant SET switch 15 is activated to advance set state counter 27 to the neutral state; the electronic timepiece, being in the timekeeping mode, proceeds counting from the intialized state.

With set state counter 27 in the non-neutral state, a selected one of the set control lines (SET MONTH, SET DATE, SET DAY, SET HOUR, SET MINUTE) is activated according to the count of set state counter 27. The set control lines are coupled to counters 22–26 via respective NAND gates 38, 40, 42, 44 or 46. The other input of each of the NAND gates 38, 40, 42, 44 and 46 is coupled in common to COMMAND switch 14 so that the selected counter will be advanced only during activation of COMMAND switch 14. The set/command signal at the output of the selected NAND gate 38, 40, 42, 44 or 46 is applied via a respective NOR gate 39, 41, 43, 45 or 47 along with an ADVANCE clock signal (2 Hz, for example) to the respective counter 22–26 so that the selected counter is set at the ADVANCE clock signal rate to a selected value. As previously indicated, the SET MODE signal is present during all five of the function-setting modes to prevent carry propogation from the counter being set to the next counter in the chain.

Figure 4:
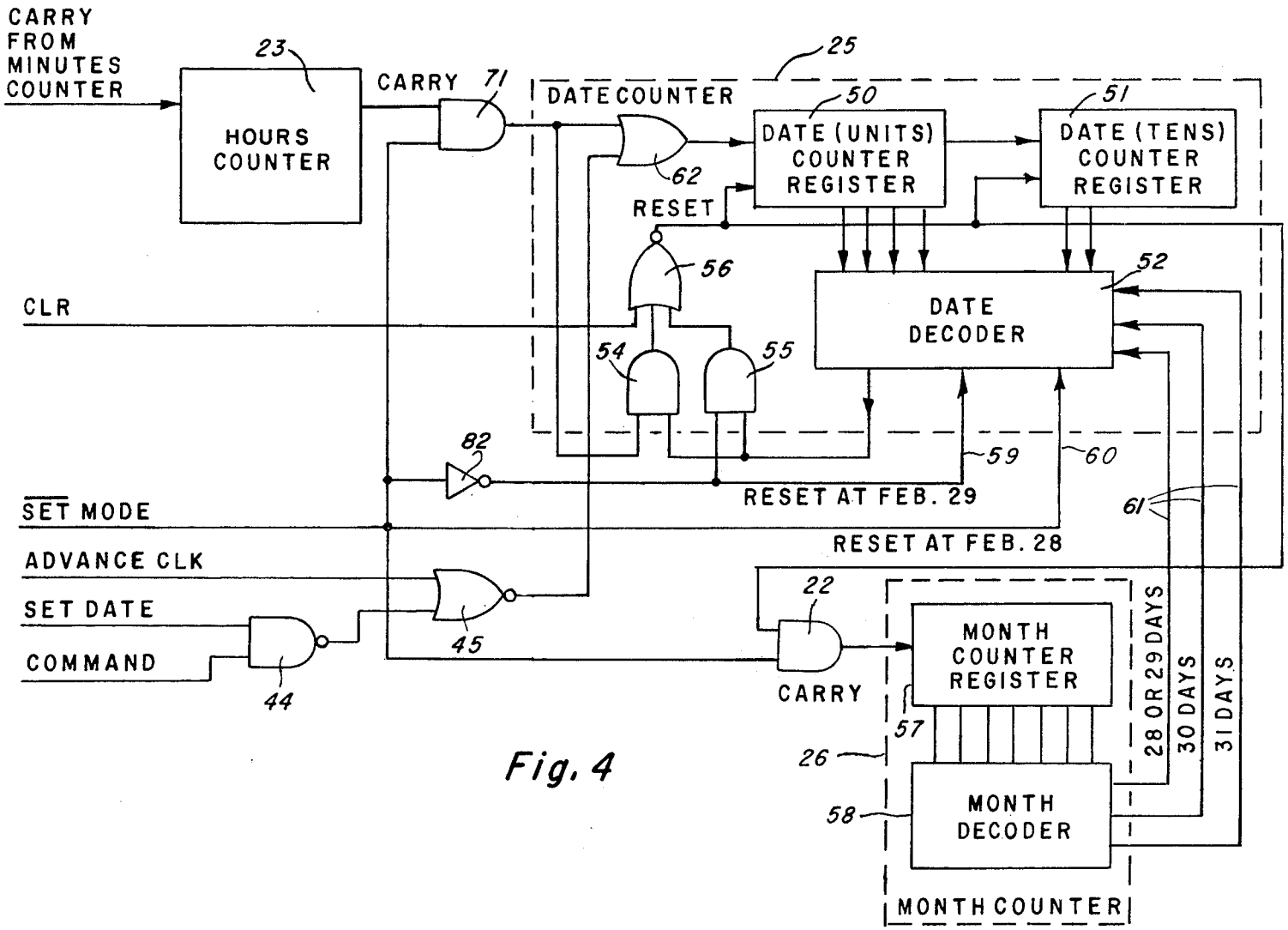
FIG. 4 is a circuit diagram of the selection circuit and its connection to the other electronic watch circuitry.

Referring now to FIG. 4, date counter 25 and month counter 26, including the automatic selection circuit for determining the number of days per month, are shown in particular detail. The carry signal from hours counter 23 is applied by means of OR gate 62 to date (units) counter register 50 to advance date units once each 24 hours. The carry output from date (units) counter register 50 is applied to date (tens) counter register 51; counter register 51 is advanced one count each 10 date units. The contents of date counter registers 50 and 51 are decoded by means of date decoder 52 which generates a reset signal via one of NAND gates 54 or 55, through NOR gate 62 to reset counter register 50 to a "one" count, reset date counter register 51 to a "zero" count and to propagate a carry signal to month counter register 57 to advance counter 57 to the next month. Thus, date decoder 52 resets date counter registers 50 and 51 to the first day of the month after 31 days. 30 days, 29 days or 28 days, depending upon the particular month and other conditions which will henceforth be described. The output of month counter register 57 is decoded by month 58, and applies a signal (NO, DAYS) to date decoder 52 indicating the number of days in the present month. For February, however, the number of days is not directly determinable as there may be either 28 days during a normal year or 29 days during a leap year. In accordance with the present invention, the SET MODE signal is applied to date decoder 52 which thereby detects whether the electronic timepiece is in the set or timekeeping mode. If month decoder 58 indicates by a signal on line 61 that the month is February, and the timepiece is in the timekeeping mode (SET MODE = "1") as indicated by a logic "1" signal on line 60, and the output of counter registers 50 and 51 are a BCD "28", date decoder 52 generates a RESET signal to reset counter registers 50, 51 and 57 to March 1. The actual resetting occurs when a carry is generated by hours counter 23 which enables NAND gate 54. If the electronic timepiece is in the set mode (SET MODE = "0") as indicated by a logic "1" signal from NOT gate 82 on line 59, and month decoder 58 indicates on line 61 that the month is February, date decoder 52 will generate a RESET signal to counter registers 50 and 51 only after cycling through 29 days rather than 28 days. The reset signal during the setting process is by means of NAND gate 55 which resets counter registers 50 and 51 to a BCD "01" as the registers are advanced by means of gates 44 and 45 as previously discussed with respect to FIG. 3. AND gate 72 disables the carry signal to month counter register 57 so that counter register 57, which is already set to February, is not advanced as counter registers 50 and 51 are being set to "29".

Thus, the automatic date decoder and selection circuit of the present invention automatically selectively advances the month and date counters to the first day of the next month. The circuit automatically cycles 28 days for February, so long as the timepiece is in the timekeeping mode and cycles 29 days for February in the timesetting mode thereby permitting the timepiece to be set to February 29 leap years. After being set to February 29, the month and date counters are automatically advanced to March 1 the next day.

The novel features of the invention have now been described in detail with respect to preferred embodiments thereof. Since it is obvious that many changes and modifications can be made in the above details without departing from the nature and spirit of the invention, it is understood that the invention is not to be limited to said details except as set forth in the appended claims.

What is claimed is:

1. An electronic timepiece having a timekeeping mode, in which said timepiece is in its normal operating mode for indicating time, and a timesetting mode, in which said timepiece is manually settable to a selected indication of time, said electronic timepiece comprising:

(a) means for indicating a plurality of time-related functions including the month and date; and (b) means for advancing said indicating means from February 28 to March 1 when the electronic timepiece is in said timekeeping mode and for allowing said indicating means to be manually advanced from February 28 to February 29 when the electronic timepiece is in the timesetting mode.

2. An electronic timepiece accordng to claim 1 including:

(a) month decoder means coupled to said month indicating means for determining the number of days in each month; and (b) date decoder means coupled to said date indicating means and to said month decoder means and being responsive to the timekeeping and timesetting modes of said electronic timepiece for selectively controlling the resetting of said date indicating means and for selectively advancing said month-indicating means.

3. An electronic timepiece according to claim 2 including:

(a) at least one switch means for controlling the setting of said time-related functions;

(b) selector means coupled to said switch means and responsive to the activation thereof for selecting a state indicative of said timepiece being in one of said timekeeping mode and said timesetting mode and for selecting one of said plurality of time-related functions to be set when said timepiece is in said timesetting mode; and (c) means coupling said date decoder means to said selector means wherein said date decoder means decodes the date in accordance with the state of said selector means.

4. An electronic timepiece which displays a plurality of time-related functions including month and date, said timepiece having a timekeeping mode, in which said timepiece is in its normal operating made of indicating time, and a timesetting mode, in which said timepiece is manually settable to a selected indication of time, comprising:

(a) a plurality of counter means including date counter means and month counter means;

(b) decoder means coupled to said month counter for determining the number of days of the month contained in said month counter;

(c) timesetting means for setting the counter of said electronic timepiece; and (d) date decoder means responsive to said month decoder means and to said timesetting means for selectively resetting said date counter means and for selectively advancing said month counter means in response to said date counter means having counted the number of days determined by said date decoder means, said date decoder means resetting said date counter means and advancing said month counter means at February 28 when said electronic timepiece is in the timekeeping mode, and for permitting said date counter means to be set to February 29 when said electronic timepiece is in the timesetting mode.

5. An electronic timepiece according to claim 4 including logic gate means coupling said date decoder means to said month counter means, said logic gate means being coupled to said timesetting means for enabling the advancing of said month counter means by said date decoder means when said electronic timepiece is in the timekeeping mode and for disabling the advancing said month counter means by said date decoder means when said electronic timepiece is in the timesetting mode.

6. An electronic timepiece according to claim 4, wherein said timesetting means includes at least one manually-operated switch and a selector circuit, said selector circuit having a neutral state in which said electronic timepiece is in said timekeeping mode and a plurality of time-related function setting states in which said electronic timepiece is in said timsetting mode, each of said time function setting states controlling the setting of a respective one of said plurality of counter means.

7. An electronic timepiece having a timekeeping mode, in which said timepiece is in its normal operating mode for indicating time, and a timesetting mode, in which said timepiece is manually settable to a selected indication of time, comprising:

(a) an electronic timekeeping circuitry responsive to a reference frequency signal for generating electrical signals indicative of a plurality of time-related functions including month and date, said timekeeping circuitry including:

(i) a plurality of counter means including date counter means and month counter means;

(ii) decoder means coupled to said month counter for determining the number of days of the month contained in said month counter;

(iii) timesetting control means for controlling the setting of said counters; and (iv) date decoder means coupled to said month decoder means and to said timesetting means for selectively advancing said month counter means in response to said date counter means having counted the number of days determined by said date decoder means, said date decoder means including means responsive to said timesetting control means for resetting said date counter means and advancing said month counter means at February 28 when said electronic timepiece is in the timekeeping mode, and for permitting said date counter means to be set to February 29 when electronic timepiece is in the timsetting mode; and (b) display means coupled to said counter means for displaying said time-related functions.

8. An electronic timepiece according to claim 7, wherein said timesetting means includes a selector circuit, said selector circuit having a neutral state in which said electronic timepiece is in said timekeeping mode and a plurality of time function setting states in which said electronic timepiece is in said timesetting mode, each of said time function setting states controlling the setting of a respective one of said counter means; and wherein said electronic timepiece includes a manually-operated switch means coupled to said selector circuit for activating said selector circuit.

9. An electronic timepiece according to claim 8 including a watch housing having a lens member, said electronic timekeeping circuitry and display means being contained within said housing with said display means being visible from the exterior of said housing through said lens member, and an activator member extending to the exterior of said housing, said activator member being coupled to said switch means for controlling said switch means to activate said selector circuit.

10. An electronic timepiece according to claim 8 inlcuding second switch means coupled to said timekeeping circuitry for skewing the selected counter.

* * * * *